US011652302B2

(12) United States Patent
Lee

(10) Patent No.: US 11,652,302 B2
(45) Date of Patent: May 16, 2023

(54) ANTENNA DEVICE

(71) Applicant: DENSO CORPORATION, Kariya (JP)

(72) Inventor: Jungaun Lee, Kariya (JP)

(73) Assignee: DENSO CORPORATION, Kariya (JP)

( * ) Notice: Subject to any disclaimer, the term of this patent is extended or adjusted under 35 U.S.C. 154(b) by 9 days.

(21) Appl. No.: 17/526,196

(22) Filed: Nov. 15, 2021

(65) Prior Publication Data

US 2022/0263244 A1 Aug. 18, 2022

(30) Foreign Application Priority Data

Feb. 17, 2021 (JP) ..... JP2021-023685

(51) Int. Cl.

| | |
|---|---|
| ***H01Q 9/04*** | (2006.01) |
| ***H01Q 19/02*** | (2006.01) |
| ***H01Q 1/38*** | (2006.01) |
| ***H01Q 21/08*** | (2006.01) |
| ***H01Q 21/00*** | (2006.01) |

(52) U.S. Cl.

CPC ..... *H01Q 21/08* (2013.01); *H01Q 1/38* (2013.01); *H01Q 9/0414* (2013.01); *H01Q 9/0421* (2013.01); *H01Q 19/025* (2013.01); *H01Q 21/0037* (2013.01)

(58) Field of Classification Search

CPC ..... H01Q 1/38; H01Q 9/0407; H01Q 9/0414; H01Q 9/0421; H01Q 9/045; H01Q 19/025; H01Q 23/00; H01Q 21/0037; H01Q 21/0068; H01Q 21/0075; H01Q 21/061

See application file for complete search history.

(56) References Cited

U.S. PATENT DOCUMENTS

| | | | | |
|---|---|---|---|---|
| 10,122,058 | B2 * | 11/2018 | Oguri | H05K 1/028 |
| 2008/0048917 | A1 | 2/2008 | Achour et al. | |
| 2008/0258981 | A1 * | 10/2008 | Achour | H01Q 21/065 343/702 |
| 2010/0238081 | A1 | 9/2010 | Achour et al. | |
| 2010/0283692 | A1 | 11/2010 | Achour et al. | |
| 2010/0283705 | A1 | 11/2010 | Achour et al. | |
| 2011/0039501 | A1 | 2/2011 | Achour et al. | |
| 2022/0393365 | A1 * | 12/2022 | Wu | H01Q 19/005 |

FOREIGN PATENT DOCUMENTS

JP 2008-005164 A 1/2008

* cited by examiner

*Primary Examiner* — Ab Salam Alkassim, Jr.
*Assistant Examiner* — Leah Rosenberg
(74) *Attorney, Agent, or Firm* — Posz Law Group, PLC

(57) ABSTRACT

An antenna device includes a substrate having a base material containing a dielectric and a conductor, a waveguide, an antenna, and a matching portion arranged in the base material as a part of the conductor. The antenna faces the upper wall portion, and has a plurality of patch portions arranged in an array, a plurality of feeding lines extending in a direction from the patch portion and individually provided for the patch portions, and a plurality of short-circuit portions individually provided for the patch portions and electrically connecting the patch portion and the upper wall portion. The upper wall portion has a plurality of openings 34 individually formed with respect to the feeding lines. Each of the feeding lines extends into the waveguide through the corresponding opening.

7 Claims, 11 Drawing Sheets

ANTENNA DEVICE

CROSS REFERENCE TO RELATED APPLICATION

The present application is based on Japanese Patent Application No. 2021-23685 filed on Feb. 17, 2021, disclosure of which is incorporated herein by reference.

TECHNICAL FIELD

The present disclosure relates to an antenna device.

BACKGROUND

In an antenna device, an array antenna and a waveguide are formed on a same substrate. A strip line is used to supply power to the array antenna.

SUMMARY

One object of the present disclosure is to provide an antenna device that can reduce loss while improving gain.

An antenna device disclosed herein includes a substrate having a base material containing a dielectric and a conductor arranged in the base material, a waveguide that is arranged in the base material as a part of the conductor, and has an upper wall portion, a lower wall portion facing the upper wall portion in a plate thickness of the base material, and a side wall portion connected to the upper wall portion and the lower wall portion, an antenna that is arranged in the base material as a part of the conductor, and has a plurality of patch portions arranged in an array so as to face the upper wall portion in the plate thickness direction, a plurality of feeding lines extending in the plate thickness direction from the patch portion and individually provided for the patch portions, and a plurality of short-circuit portions individually provided for the patch portions and electrically connecting the patch portion and the upper wall portion, and a matching portion that is arranged in the base material as a part of the conductor and is individually provided with respect to the patch portion in order to match an impedance of the waveguide and an impedance of the antenna.

The upper wall portion has a plurality of openings individually formed with respect to the feeding lines.

Each of the feeding lines extends into the waveguide through the corresponding opening.

DETAILED DESCRIPTION

Figure 1:
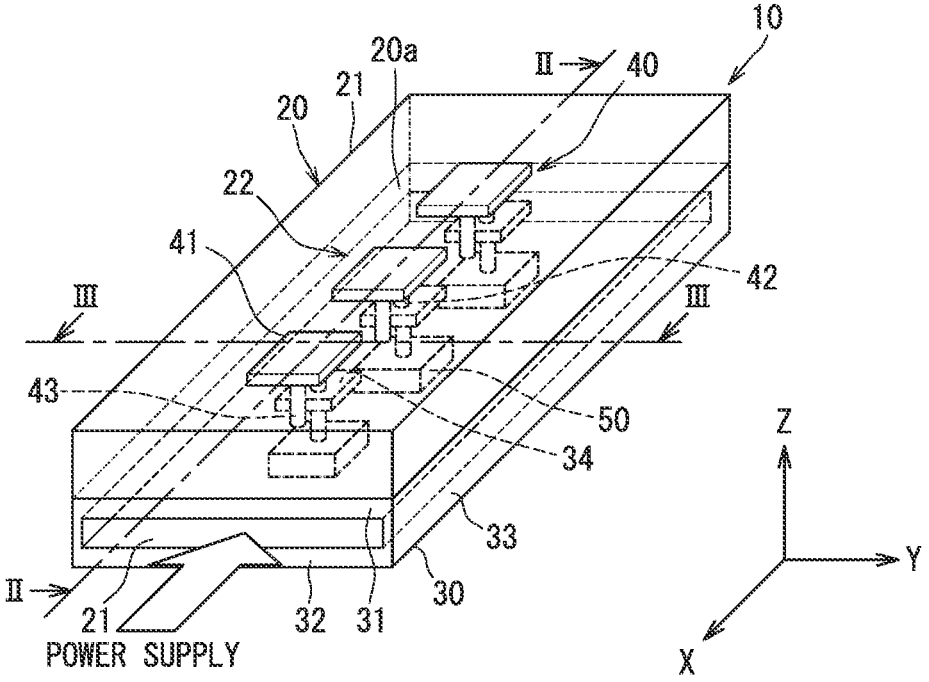
FIG. 1 is a perspective view showing an example of an antenna device according to a first embodiment.

In an assumable example of an antenna device, an array antenna and a waveguide are formed on a same substrate. A strip line is used to supply power to the array antenna. The disclosure of the patent document (JP 2008-5164 A) relating to the strip line is incorporated herein by reference as an explanation of the technical elements in this disclosure.

When a band such as a millimeter wave band becomes high, a radiation loss increases due to the increase in the amount of radiation from the strip line. Further, in an electric field formed in a plate thickness direction of the substrate for radio wave propagation of the strip line, the amount of the electric field spreading in the substrate increases, so that the dielectric loss increases. Further improvements are required in the antenna device in the above-mentioned viewpoint or in other viewpoints not mentioned.

One object of the present disclosure is to provide an antenna device that can reduce loss while improving gain.

An antenna device disclosed herein includes a substrate having a base material containing a dielectric and a conductor arranged in the base material, a waveguide that is arranged in the base material as a part of the conductor, and has an upper wall portion, a lower wall portion facing the upper wall portion in a plate thickness of the base material, and a side wall portion connected to the upper wall portion and the lower wall portion, an antenna that is arranged in the base material as a part of the conductor, and has a plurality of patch portions arranged in an array so as to face the upper wall portion in the plate thickness direction, a plurality of feeding lines extending in the plate thickness direction from the patch portion and individually provided for the patch portions, and a plurality of short-circuit portions individually provided for the patch portions and electrically connecting the patch portion and the upper wall portion, and a matching portion that is arranged in the base material as a part of the conductor and is individually provided with respect to the patch portion in order to match an impedance of the waveguide and an impedance of the antenna.

The upper wall portion has a plurality of openings individually formed with respect to the feeding lines.

Each of the feeding lines extends into the waveguide through a corresponding opening.

According to the disclosed antenna device, the waveguide, the antenna, and the matching portion are formed in the substrate. The antenna has a plurality of patch portions arranged in an array, and a gain can be improved. Further, the feeding line extends from the patch portion to the inside of the waveguide through the opening. The feeding line extends in the plate thickness direction from the patch portion, instead of extending in a direction orthogonal to the plate thickness direction as in the strip line. Therefore, even in a high frequency band such as a millimeter wave band, radiation from the feeding line can be suppressed, that is, radiation loss can be suppressed. It is not a power supply by forming an electric field in the plate thickness direction for radio wave propagation like a microstrip line, so that the amount of electric field spreading in the substrate is small, and the dielectric loss due to the feeding line can be suppressed. As a result, it is possible to provide the antenna device that can reduce the loss.

The disclosed aspects in this specification adopt different technical solutions from each other in order to achieve their respective objectives. The objects, features, and advantages disclosed in this specification will become apparent by referring to following detailed descriptions and accompanying drawings.

Hereinafter, multiple embodiments will be described with reference to the drawings. The same reference numerals are assigned to the corresponding elements in each embodiment, and thus, duplicate descriptions may be omitted. When only a part of the configuration is described in the respective embodiments, the configuration of the other embodiments described before may be applied to other parts of the configuration. Further, not only the combinations of the configurations explicitly shown in the description of the respective embodiments, but also the configurations of the plurality of embodiments can be partially combined even when they are not explicitly shown as long as there is no difficulty in the combination in particular.

FIRST EMBODIMENT

The antenna device is configured to transmit and/or receive radio waves of a predetermined operating frequency. The antenna device is used, for example, in a high-speed wireless transmission system in the 80 GHz band.

<Antenna Device>

Figure 2:
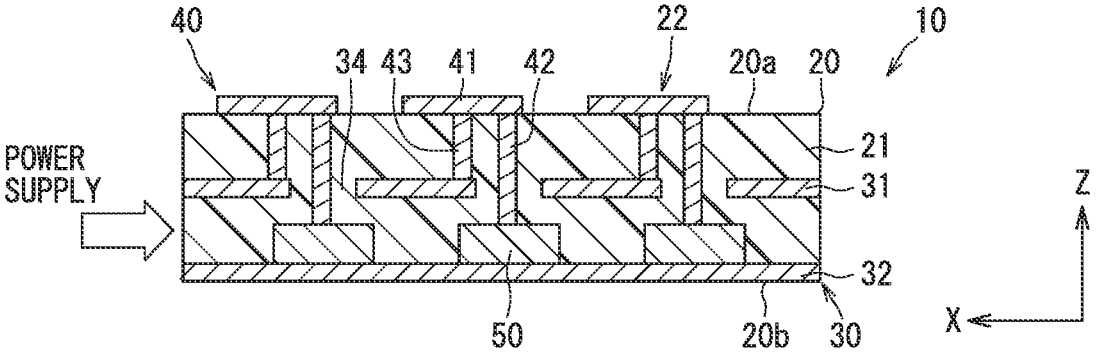
FIG. 2 is a cross-sectional view taken along a line II-II of FIG. 1.
Figure 3:
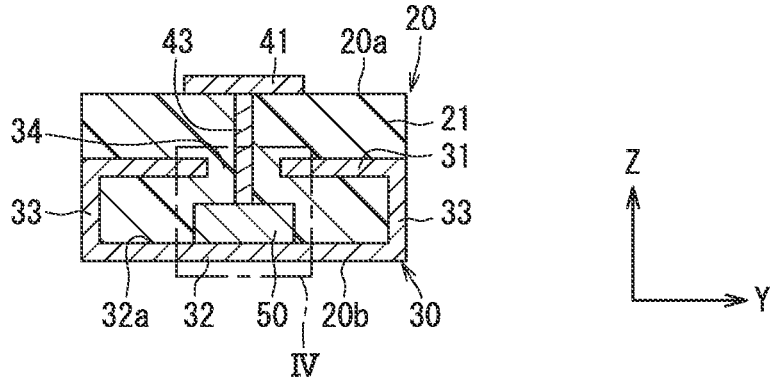
FIG. 3 is a cross-sectional view taken along a line III-III of FIG. 1.
Figure 4:
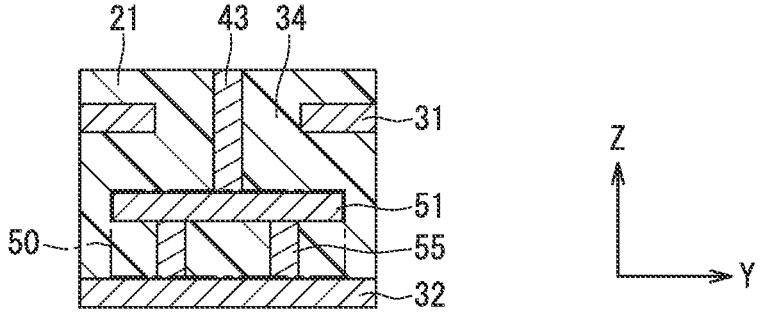
FIG. 4 is an enlarged view of region IV of FIG. 3.

First, the antenna device will be described with reference to FIGS. 1 to 4. FIG. 1 is a perspective view showing a schematic configuration of an example of an antenna device. FIG. 2 is a cross-sectional view taken along a line II-II of FIG. 1. FIG. 3 is a cross-sectional view taken along a line III-III of FIG. 1. FIG. 4 is an enlarged view of the region IV shown by an alternate long and short dash line in FIG. 3 in order to show a configuration of a matching portion. That is, in FIGS. 1 to 3, the matching portion 50 is shown in a simplified manner. The white arrows shown in FIGS. 1 and 2 indicate a feeding direction. In other figures as well, the feeding direction is indicated by the white arrow.

As shown in FIGS. 1 to 4, the antenna device 10 includes a substrate 20, a waveguide 30, an antenna 40, and a matching portion 50. In the following, a plate thickness direction of the substrate 20 is defined as a Z direction, and one direction orthogonal to the Z direction is defined as a X direction. A direction orthogonal to the Z direction and the X direction is defined as a Y direction. Unless otherwise specified, a shape viewed in a plane from the Z direction, that is, a shape along an XY plane defined by the X and Y directions is referred to as a planar shape. The plan view from the Z direction may be simply referred to as a plan view.

The substrate 20 has a base material 21 and a conductor 22. The substrate 20 may be referred to as a printed circuit board or a wiring board. The substrate 20 includes a front surface 20*a* and a back surface 20*b* as a surface opposite to the front surface 20*a* in the Z-direction. The base material 21 contains a dielectric material such as a resin. By using the base material 21, a wavelength shortening effect by the dielectric material can be expected. As the base material 21, for example, a material made of only a resin, a combination of a resin and a glass cloth, a non-woven fabric, or the like, a material containing ceramic, or the like can be adopted. The base material 21 is sometimes referred to as an insulating base material. The base material 21 is configured by, for example, laminating an insulating layer containing a dielectric material in multiple layers.

The conductor 22 is arranged in the base material 21. The conductor 22 is formed on a printed circuit board by using a general wiring technique. The conductor 22 includes a conductor pattern and a via conductor. The conductor pattern is sometimes referred to as a conductor layer. The conductor pattern is arranged in multiple layers in the base material 21. That is, the substrate 20 is a multilayer substrate. The conductor pattern is formed by patterning a metal foil such as a copper foil. A via conductor is formed by arranging a conductor such as plating in a through hole (via) formed in an insulating layer constituting the base material 21.

In the antenna device 10, elements other than the substrate 20 are arranged in the base material 21 as a part of the conductor 22. The waveguide 30, the antenna 40, and the matching portion 50 are configured by using the conductor 22. That is, the waveguide 30, the antenna 40, and the matching portion 50 are formed on the substrate 20. The substrate 20 may include only the components of the waveguide 30, the antenna 40, and the matching portion 50 as the conductor 22, or may include circuit elements other than the above-mentioned components.

The waveguide 30 is a transmission path for supplying power to the antenna 40. Radio waves propagate in the waveguide 30. As described above, the waveguide 30 is arranged in the base material 21 as a part of the conductor 22. The waveguide 30 has an upper wall portion 31, a lower wall portion 32, and a side wall portion 33. The upper wall portion 31, the lower wall portion 32, and the side wall portion 33 are a part of the conductor 22 arranged in the base material 21. The upper wall portion 31 and the lower wall portion 32 are arranged to face each other with a predetermined distance in the Z direction.

In the present embodiment, the lower wall portion 32 is formed by a surface layer pattern on the back surface 20*b* side of the substrate 20. The surface layer pattern is a conductor pattern arranged on the surface layer (front surface) of the base material 21. On the other hand, an inner layer pattern described later is a conductor pattern arranged inside the base material 21. The upper wall portion 31 is located between the lower wall portion 32 and a patch portion 41 described later in the Z direction. That is, the upper wall portion 31 is arranged at a position closer to the patch portion 41 than the lower wall portion 32. The side wall portion 33 is connected to the upper wall portion 31 and the lower wall portion 32. As described above, the waveguide 30 is a transmission path having a tunnel structure surrounded by the upper wall portion 31, the lower wall portion 32, and the side wall portion 33. The waveguide 30 extends in the X direction, and power is supplied to the waveguide 30 from one end side in the X direction.

The waveguide 30 has a substantially rectangular ring shape. Such a waveguide 30 is sometimes referred to as a rectangular waveguide. The base material 21 is arranged inside the waveguide 30. In the waveguide 30, a width, which is an opening length in the Y direction, is longer than a height, which is the opening length in the Z direction. The width of the waveguide 30 is set within the range of $0.5\times\lambda\varepsilon$ or more and $1\times\lambda\varepsilon$ or less, that is, ½ wavelength or more and 1 wavelength or less with respect to a wavelength λε of a radio wave of an operating frequency. The wavelength λε is a wavelength in consideration of the dielectric material (relative dielectric constant). The wavelength λε can be obtained by a square root of a value obtained by dividing (300 [mm/s]/operating frequency [GHz]) by the dielectric constant of the base material 21. The height of the waveguide 30 is set to about ½ wavelength, for example, in the range of 0.4×λε to 0.6×λε. By setting such a length, radio waves propagate in the waveguide 30.

The waveguide 30 has an opening 34. The opening 34 is formed in the upper wall portion 31. The opening 34 penetrates the upper wall portion 31 in the Z direction. The opening 34 is formed so that a feeding line 42, which will be described later, can be extended to an inside of the waveguide 30. The openings 34 are individually formed with respect to the feeding line 42. The opening 34 is formed so as to overlap a part of the corresponding patch portion 41 in a plan view. The opening 34 is formed in such a size that it does not come into contact with the feeding line 42 and radio waves do not leak from the waveguide 30.

The opening 34 has a substantially circular shape in a plan view. A diameter D of the opening 34 can be calculated from a following equation (1). Here, d is the diameter of the feeding line 42, ε is the relative permittivity of the base material 21, and $Z_0$ is an impedance converted by the matching portion 50.

[Equation 1]

$$Z_0 = \frac{138}{\sqrt{\epsilon}} \log_{10} \frac{D}{d} \tag{1}$$

The antenna 40 has the patch portion 41, the feeding line 42, and a short-circuit portion 43. The antenna 40 uses the upper wall portion 31 (waveguide 30) as a ground board of the antenna 40. The upper wall portion 31 functions as the ground board of the antenna 40. The ground board is connected to a feeder circuit (not shown) to supply a ground potential of the antenna device 10. An opening is provided in the lower wall portion 32 of the waveguide 30, and the upper wall portion 31 provides a ground potential by electrically connecting, for example, a standard waveguide, an outer conductor of a coaxial cable, or the like. The direction perpendicular to a plate surface of the ground board 30 is also substantially parallel to the Z direction. In a plan view, the area of the ground board is larger than the area of the patch portion 41. The ground board has a size that includes the patch portion 41. The ground board preferably has a size necessary for the antenna 40 to operate stably.

The patch portion 41 is arranged in the base material 21 as a part of the conductor 22 so as to function as a radiation element. The patch portion 41 includes the conductor pattern described above. The arrangement of the conductor patterns constituting the patch portion 41 in the Z direction is not particularly limited. It may be a surface layer pattern or an inner layer pattern. The patch portion 41 is arranged to face the upper wall portion 31 so as to have a predetermined distance from the ground board, that is, the upper wall portion 31 in the Z direction. The patch portion 41 may be referred to as a radiation element or an antenna element. In a plan view, the entire patch portion 41 overlaps with the upper wall portion 31. That is, the entire plate surface (lower surface) of the patch portion 41 faces the upper wall portion 31 in the Z direction. The patch portion 41 is arranged substantially parallel to the upper wall portion 31. Substantially parallel is not limited to perfect parallelism.

The patch portion 41 of the present embodiment is arranged on the front surface 20*a* of the substrate 20. The patch portion 41 is a surface layer pattern on the front surface 20*a* side of the substrate 20. A basic shape of the patch portion 41 is a substantially square in the plan view. The basic shape is an outer contour of the patch portion 41 in a plan view. The patch portion 41 has four sides that define the outer contour in the plan view. The patch portion 41 may have slits on at least one of the four sides.

By arranging the patch portion 41 facing the upper wall portion 31 which is the ground board, a capacitor is formed according to the area of the patch portion 41 and the distance from the ground board. The patch portion 41 is formed to have a size that forms a capacitance that performs parallel resonance with the inductance of the short-circuit portion 43 at a target frequency. The area of the patch portion 41 is appropriately designed to provide the desired capacitance and thus to operate at the operating frequency.

In the present embodiment, the basic shape, in other words, the outer contour of the patch portion 41 is square as an example, but as another configuration, the planar shape of the patch portion 41 may be circular, regular octagon, regular hexagon, or the like. The basic shape of the patch portion 41 may have a line-symmetrical shape, that is, a bidirectional line-symmetric shape, with each of two straight lines orthogonal to each other as axes of symmetry. The bidirectional line symmetrical shape refers to a figure that is line-symmetric with a first straight line as an axis of symmetry, and that is also line-symmetric with respect to a second straight line that is orthogonal to the first straight line. The bidirectional line symmetrical shape corresponds to, for example, an ellipse, a rectangle, a circle, a square, a regular hexagon, a regular octagon, a rhombus, or the like. Further, the patch portion 41 may also be a point-symmetrical figure such as a circle, a square, a rectangle, or a parallelogram.

The feeding line 42 is arranged in the base material 21 as a part of the conductor 22 in order to supply power to the patch portion 41. The feeding line 42 is electrically connected to the patch portion 41. The feeding line 42 includes the via conductor described above. The power supply method is not limited to a direct power supply method. A power supply method in which the feeding line 42 and the patch portion 41 are electromagnetically coupled may also be adopted. One of the ends of the feeding line 42 is electrically connected to the patch portion 41. The electrical connection part between the patch portion 41 and the feeding line 42 is the feeding point. The feeding line 42 extends in the Z direction. Another end of the feeding line 42 is located inside the waveguide 30. The feeding line 42 extends from the patch portion 41 (feeding point) to the inside of the waveguide 30 through the opening 34 formed in the upper wall portion 31. The current input from the waveguide 30 to the feeding line 42 is conducted to the patch section 41 and resonates the patch portion 41. The feeding line 42 of the present embodiment is composed of a plurality of via conductors arranged side by side in the Z direction.

The short-circuit portion 43 is arranged in the base material 21 as a part of the conductor 22 in order to electrically connect, that is, short-circuit the upper wall portion 31 which is the ground board and the patch portion 41. The short-circuit portion 43 includes the via conductors described above. One of the ends of the short circuit portion 43 is connected to the upper wall portion 31 and the other end is connected to the patch portion 41. The short-circuit portion 43 has, for example, a substantially circular in the plan view. By adjusting the diameter and length of the short-circuit portion 43, the inductance provided in the short-circuit portion 43 can be adjusted. The short-circuit portion 43 is connected to substantially the center of the patch portion 41 in a plan view. Further, the center of the patch portion 41 corresponds to the centroid of the patch portion 41.

Since the patch portion 41 according to the present embodiment has a square shape in the plan view, the center corresponds to an intersection of two diagonal lines of the patch portion 41. The number of via conductors constituting the short-circuit portion 43 is not particularly limited. In the present embodiment, one via conductor includes the short-circuit portion 43. The short-circuit portion 43 may be formed by a plurality of via conductors arranged in parallel between the upper wall portion 31 and the patch portion 41.

The antenna 40 has a plurality of patch portions 41, feeding lines 42, and short-circuit portions 43 having the above-described configurations. The plurality of patch portions 41 are arranged to face the common (single) upper wall portion 31. The plurality of patch portions 41 are arranged in an array in the plan view. In the embodiment shown in FIGS. 1 to 4, a plurality of patch portions 41 are arranged along the X direction. Specifically, the three patch portions 41 are lined up in a row. A distance between the centers of the patch portions 41 arranged in a row is set within a range of $0.25\times\lambda\varepsilon$ or more and $1\times\lambda\varepsilon$ or less, that is, within a range of ¼ wavelength or more and 1 wavelength or less.

In the following, the number of elements may be indicated by the number of patch portions 41. FIGS. 1 to 4 show an example of three elements. The plurality of feeding lines 42 are individually provided with respect to the patch portion 41. The feeding line 42 is configured to be able to supply power to a plurality of patch portions 41 individually. A plurality of short-circuit portions 43 are also individually provided with respect to the patch portion 41. That is, the feeding line 42 and the short-circuit portion 43 are provided for each patch portion 41.

The matching portion 50 matches the impedance of the waveguide 30 with the impedance of the antenna 40. The matching portion 50 is sometimes referred to as a conversion portion because it converts impedance between the waveguide 30 and the antenna 40. For example, the impedance of the waveguide 30 is 1000 or more, and the impedance of the antenna 40 is 50 to 75Ω. The matching portion 50 converts, for example, into an impedance intermediate between the waveguide 30 and the antenna 40. The matching portion 50 may convert the impedance of the waveguide 30 to a value substantially equal to the impedance of the antenna 40.

The matching portion 50 is also arranged in the base material 21 as a part of the conductor 22. The matching portion 50 is individually provided with respect to the patch portion 41, that is, the radiation element. The matching portion 50 of the present embodiment is arranged inside the waveguide 30. As shown in FIG. 4, the matching portion 50 includes an inner layer pattern 51 and a via conductor 55. The inner layer pattern 51 corresponds to the first inner layer pattern, and the via conductor 55 corresponds to the second via conductor.

The inner layer pattern 51 is connected to the feeding line 42 at a position away from the patch portion 41 so as to face the lower wall portion 32. The inner layer pattern 51 is arranged inside the waveguide 30. The inner layer pattern 51 is located between the upper wall portion 31 and the lower wall portion 32 in the Z direction. One of the ends of the via conductor 55 is connected to the conductor pattern constituting the lower wall portion 32, and the other end is connected to the inner layer pattern 51. In this way, the matching portion 50 is connected to an inner surface 32*a* of the lower wall portion 32 and has a predetermined height from the inner surface 32*a*. The number of via conductors 55 interposed between the inner layer pattern 51 and the lower wall portion 32 is not particularly limited. Only one via conductor 55 may be arranged, or a plurality of via conductors may be arranged. In the present embodiment, three or more via conductors 55 are arranged for one inner layer pattern 51.

The matching portion 50 is connected to a tip of the feeding line 42. The conductor 22 that constitutes the matching portion 50 is electrically connected to the conductor 22 that constitutes the feeding line 42. The feeding line 42 and/or the feeding line 42 including the matching portion 50 extends below the center of the height of the waveguide 30. That is, the feeding line 42 arranged inside the waveguide 30 and/or the feeding line 42 including the matching portion 50 has a length of ¼ wavelength or more.

Figure 5:
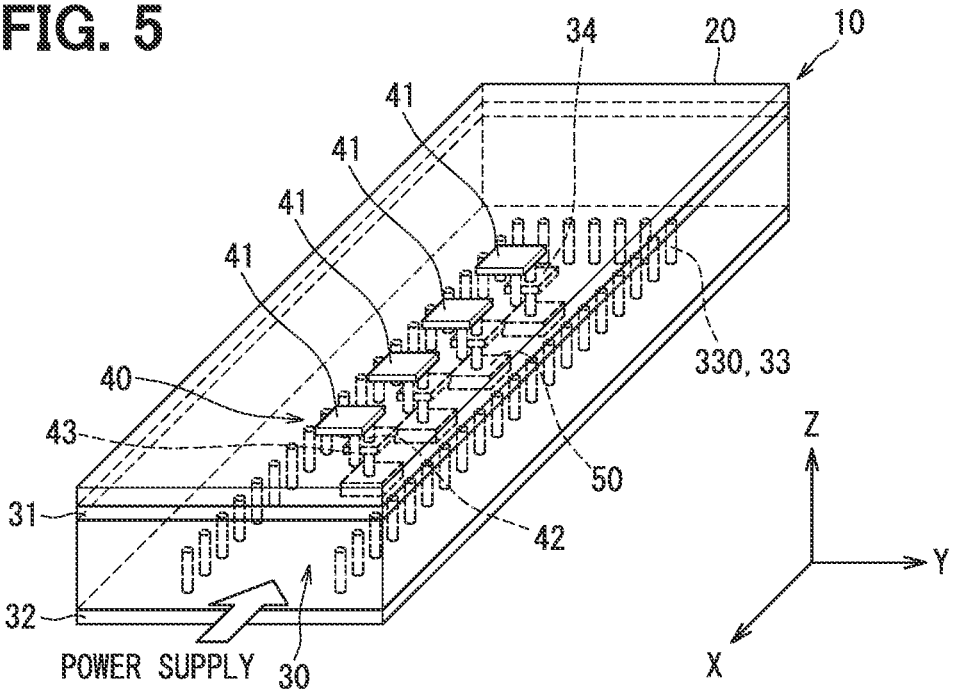
FIG. 5 is a perspective view showing an example of four elements.
Figure 6:
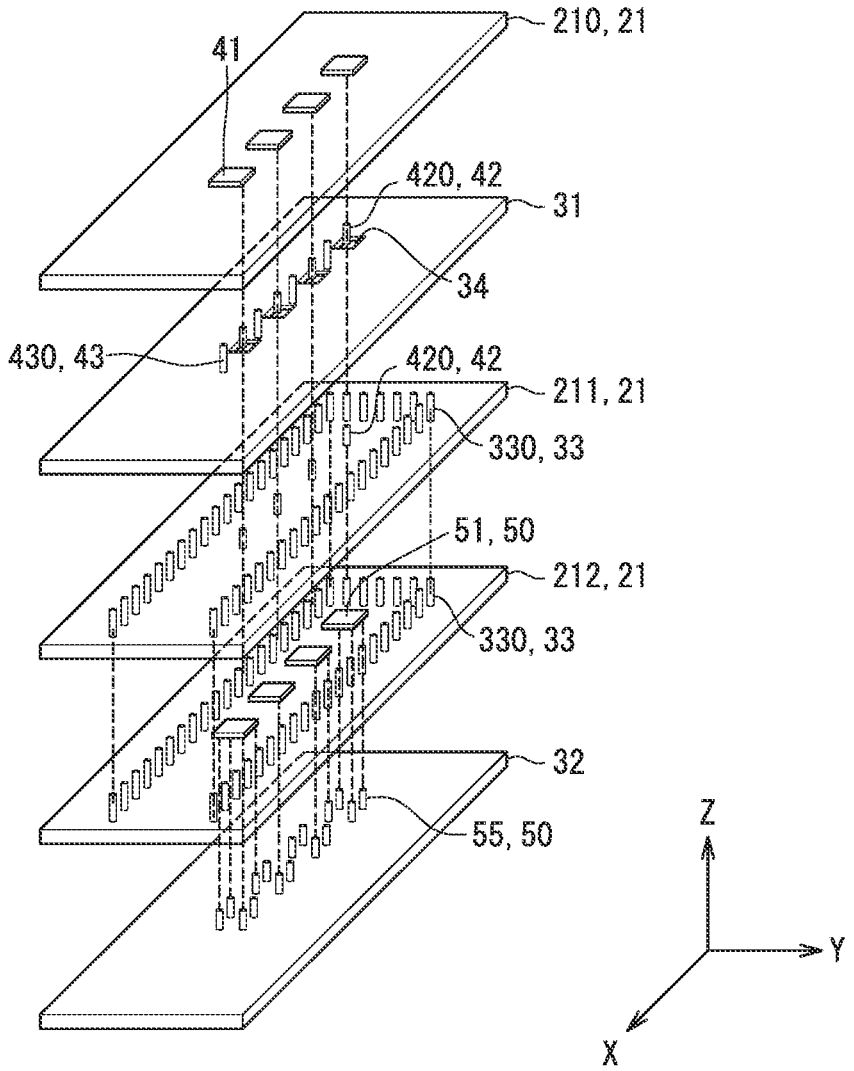
FIG. 6 is an exploded perspective view of the antenna device illustrated in FIG. 5.

FIGS. 5 and 6 show a more specific configuration example of the antenna device 10. FIG. 5 is a perspective view of the antenna device 10. In FIG. 5, the matching portion 50 is shown in a simplified manner. FIG. 6 is an exploded perspective view. FIGS. 5 and 6 show an example of four elements. The four patch portions 41 are arranged in a row in the X direction. The base material 21 is formed by laminating three insulating layers 210, 211, and 212. The conductor pattern has the patch portion 41 and the lower wall portion 32 which are surface layer patterns, and the upper wall portion 31 and the inner layer pattern 51 which are inner layer patterns. That is, four layers of conductor patterns are arranged in the base material 21.

The side wall portion 33 of the waveguide 30 is composed of a plurality of via conductors 330. The plurality of via conductors 330 are arranged at intervals so that radio waves do not leak out. The plurality of via conductors 330 are arranged so that one end side in the X direction is open so that power can be supplied and the other end side is closed. The plurality of via conductors 330 are arranged in a substantially U-shape in the plane view. The via conductor 330 is sometimes referred to as a post. The side wall portion 33 composed of the plurality of via conductors 330 is sometimes referred to as a post wall. The waveguide 30 having the side wall portion 33 made of the via conductor 330 is sometimes referred to as a post wall waveguide.

The feeding line 42 is composed of a via conductor 420. The via conductor 420 corresponds to the first via conductor. A plurality of via conductors 420 are connected to each other through the opening 34 to form the feeding line 42. The short-circuit portion 43 is composed of the via conductor 430. One of the ends of the via conductor 430 is connected to the patch portion 41 and the other end is connected to the upper wall portion 31. As described above, the matching portion 50 is composed of the inner layer pattern 51 and the via conductor 55. Four via conductors 55 are interposed between the lower wall portion 32 and one inner layer pattern 51.

<Antenna Operation>

Next, the operation of the antenna 40 will be described. As described above, the antenna 40 has a structure in which the ground board (upper wall portion 31) and the patch portion 41 facing each other are connected by the short-circuit portion 43. This structure is a so-called mushroom structure, which is the same as a basic structure of metamaterials.

Since the antenna 40 is an antenna to which a metamaterial technology is applied, the antenna 40 is sometimes called a metamaterial antenna.

Since the antenna 40 of the present embodiment is designed to operate in the zeroth-order resonant mode at a desired operating frequency, the antenna device may also be referred to as a zeroth-order resonant antenna. Among the dispersion characteristics of metamaterials, a phenomenon of resonance at a frequency at which a phase constant β becomes zero (0) is the zeroth-order resonance. The phase constant β is an imaginary part of a propagation coefficient γ of a wave propagating on a transmission line. The antenna 40 can satisfactorily transmit and/or receive radio waves in a predetermined band including the frequency at which the zeroth-order resonance occurs.

The antenna 40 operates by LC parallel resonance of a capacitor formed between the ground board and the patch portion 41 and an inductor provided in the short-circuit portion 43. The patch portion 41 is short-circuited to the ground board by the short-circuit portion 43 provided in the central region thereof. The area of the patch portion 41 is an area that forms a capacitor that resonates in parallel with the inductor of the short-circuit portion 43 at a desired frequency (operating frequency). A value of the inductor is determined according to the dimension of each part of the short-circuit portion 43, for example, the diameter and the length of the short-circuit portion 43. The value of the inductor may also be referred to as inductance.

Therefore, when electric power of the operating frequency is supplied, parallel resonance occurs due to energy exchange between the inductor and the capacitor, and an electric field perpendicular to the ground board is generated between the ground board and the patch portion 41. That is, an electric field in the Z direction is generated. This vertical electric field propagates from the short-circuit portion 43 toward the edge portion of the patch portion 41 becomes vertically polarized at the edge portion of the patch portion 41, and propagates in space. The vertically polarized wave here refers to a radio wave in which the vibration direction of the electric field is perpendicular to the ground board and the patch portion 41. Further, the antenna device 10 receives a vertically polarized wave coming from the outside of the antenna device 10 by LC parallel resonance.

The resonance frequency of the zeroth-order resonance does not depend on the antenna size. Therefore, the length of one side of the patch portion 41 can be made shorter than ½ wavelength of the zeroth-order resonance frequency. For example, even if one side has a length equivalent to a one-quarter wavelength, zeroth-order resonance can be generated. It is possible to make one side shorter than a one-quarter wavelength. However, for instance, the gain such as antenna gain is reduced.

<Directivity and Antenna Gain>

Figure 7:
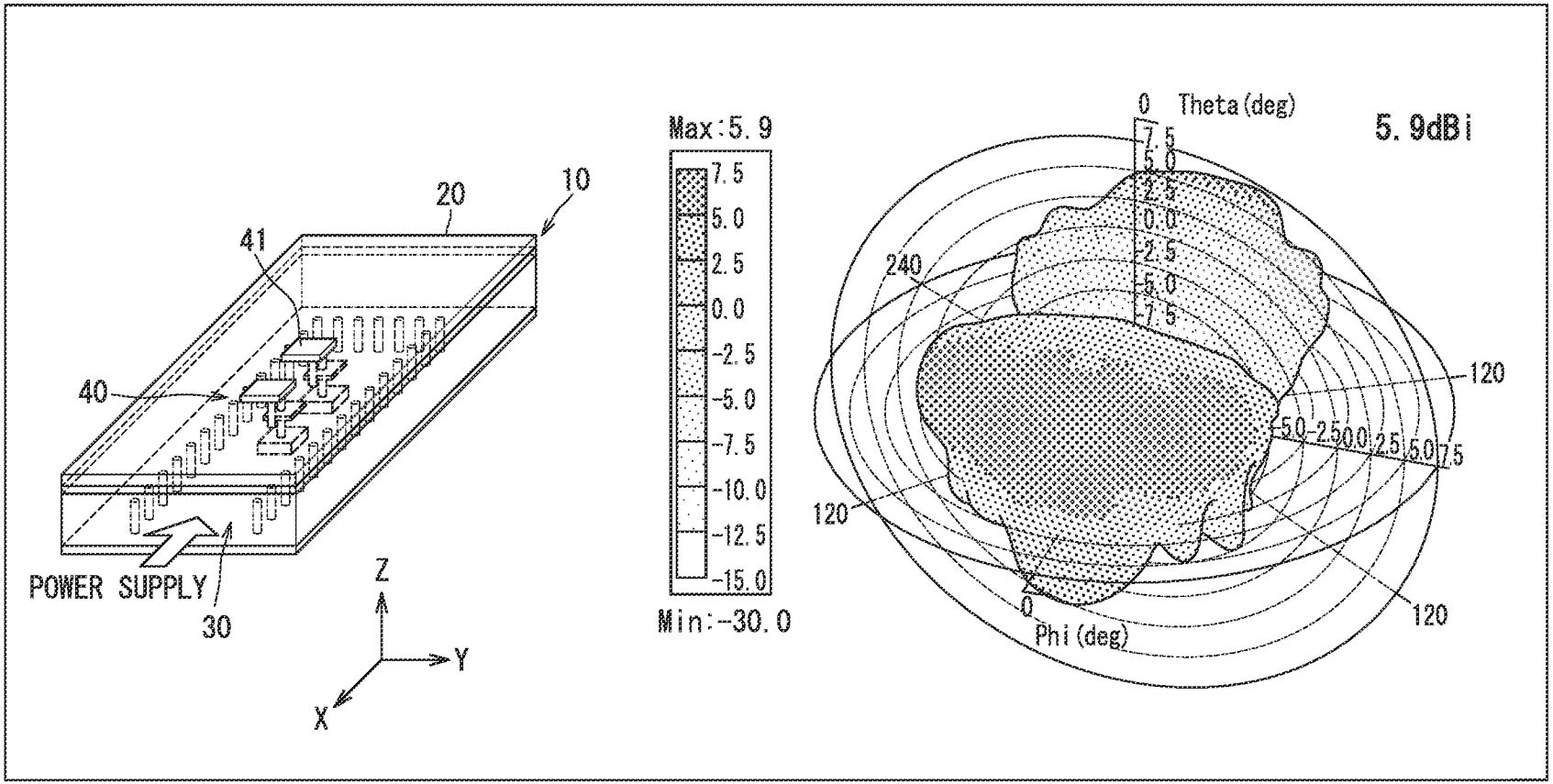
FIG. 7 is a diagram showing radiation characteristics of two elements.
Figure 8:
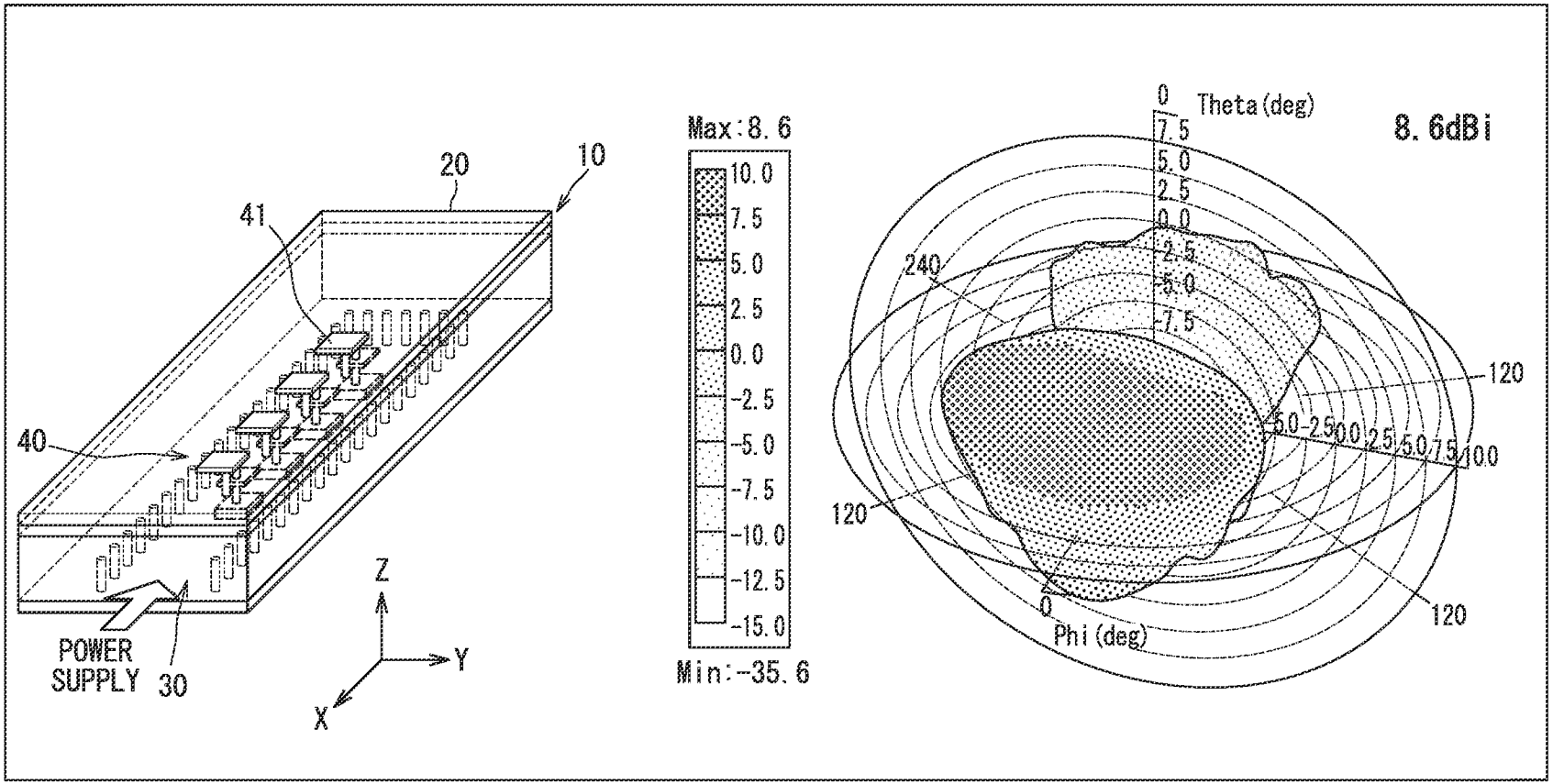
FIG. 8 is a diagram showing radiation characteristics of four elements.

FIGS. 7 and 8 illustrate a result of electromagnetic field simulation of the antenna device 10 having the above configuration. FIG. 7 shows an example of two elements. FIG. 8 shows an example of four elements as shown in FIGS. 5 and 6. The other conditions are the same as those in FIGS. 7 and 8 except that the number of elements is different. For example, the operating frequency is 82.3 GHz and the dielectric constant is 3.6.

As shown in FIG. 7, in the case of two elements, the maximum gain is 5.9 dBi. As shown in FIG. 8, in the case of 4 elements, the maximum gain is 8.6 dBi. By increasing the number of elements in this way, the maximum gain of the antenna 40 is improved. Further, each of the two elements and the four elements shows directivity in the X direction, which is the arrangement direction of the elements (patch portion 41).

Summary of First Embodiment

A metamaterial antenna has a low gain as a single unit. Therefore, in order to improve the gain, arraying is required. The metamaterial antenna is configured to have the short-circuit portion (via conductor) constituting an inductor, and the ground board and the patch portion constituting a capacitor on the substrate containing a dielectric material. A strip line is commonly used to array metamaterial antennas with such a structure. However, the strip line extends from the feeding point with the patch portion on the same surface as the patch portion, and faces the ground board in the plate thickness direction of the substrate. Therefore, when the frequency band such as the millimeter wave band becomes high, the radiation amount from the strip line increases and the radiation loss increases. Further, in an electric field formed in a plate thickness direction of the substrate for radio wave propagation of the strip line, the amount of the electric field spreading in the substrate increases, so that the dielectric loss increases. In this way, the loss tends to be large.

In the present embodiment, the waveguide 30, the antenna 40, and the matching portion 50 are formed in the substrate 20. The antenna 40 has a plurality of patch portions 41 arranged in an array. Gain can be improved by arranging. Further, the feeding line 42 extends from the patch portion 41 to the inside of the waveguide 30 through the opening 34 formed in the upper wall portion 31. The feeding line 42 does not extend in the direction orthogonal to the Z direction like the strip line, but extends in the Z direction from the patch portion 41. Therefore, even in a high frequency band such as a millimeter wave band, radiation from the feeding line 42 can be suppressed, that is, radiation loss can be suppressed. It is not a power supply by forming an electric field in the Z direction for radio wave propagation like a microstrip line, so that the amount of electric field spreading in the substrate 20 is small, and the dielectric loss due to the feeding line 42 can be suppressed. As a result, it is possible to provide the antenna device 10 that can reduce the loss.

Further, in the present embodiment, each of the feeding lines 42 includes the via conductor 420. As a result, the feeding line 42 extending in the Z direction can be realized in the substrate 20. In addition, the configuration of the feeding line 42 can be simplified.

Further, in the present embodiment, the matching portion 50 includes the inner layer pattern 51 and the via conductor 55 arranged inside the waveguide 30. The inner layer pattern 51 is connected to the feeding line 42 at a position away from the patch portion 41 so as to face the lower wall portion 32. The via conductor 55 is connected to the inner layer pattern 51. The matching portion 50 is connected to the inner surface 32*a* of the lower wall portion 32 and has a predetermined height from the inner surface 32*a*.

In this way, by providing the matching portion 50 having a predetermined height from the inner surface 32*a* of the lower wall portion 32, the opening area of the waveguide 30 becomes narrower in the arranged portion of the matching portion 50 than in the non-arranged portion thereof. Therefore, the impedance of the waveguide 30 can be converted into a value close to the impedance of the antenna 40 or a value equal to the impedance of the antenna 40. For example, assuming that the impedance of the waveguide 30 is 100Ω and the impedance of the antenna 40 is 50Ω, the impedance of the matching portion 50 can be 75Ω or 50Ω. Since the matching portion 50 can be configured by a part of the conductor 22 of the substrate 20, the configuration can be simplified. Since the matching portion 50 is provided on each of the feeding lines 42, the impedance can be matched between each of the elements and the waveguide 30.

The configuration of the matching portion 50 is not limited to the above example. In the modified example shown in FIG. 9, the matching portion 50 is arranged inside the waveguide 30 as in FIG. 4. The matching portion 50 is composed of the inner layer patterns 51 and the via conductors 55 arranged in multiple stages. Specifically, it has a two-stage structure by adding one stage including the via conductor 55 and an inner layer pattern 51 to the matching portion 50 shown in FIG. 4. According to this structure, the height of the matching portion 50 can be made higher, and the opening area of the waveguide 30 can be made smaller.

Figure 9:
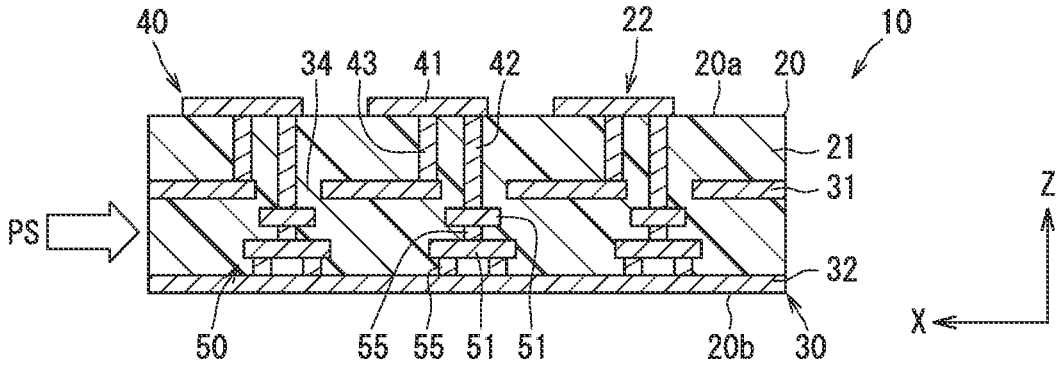
FIG. 9 is a cross-sectional view showing a modified example.

In FIG. 9, the area of the upper inner layer pattern 51 near the patch portion 41 is smaller than the area of the lower inner layer pattern 51. According to this configuration, the band can be widened. The area is an area when viewed in a plan view, that is, an area facing the lower wall portion 32. The area relationship between the upper inner layer pattern and the lower inner layer pattern is not limited to the above example. For example, the upper inner layer pattern may have the same configuration as the lower inner layer pattern. Further, the number of stages of the matching portion 50 is not limited to two-stage structure. The number of stages of the matching portion 50 may be 3 or more.

SECOND EMBODIMENT

The second embodiment is a modification of the preceding embodiment as a basic configuration and may incorporate description of the preceding embodiments. In the above embodiment, the matching portion was formed by the inner layer pattern and the via conductor located between the upper wall portion and the lower wall portion. Instead of this configuration, the matching portion may be formed by the inner layer pattern located at the opening.

Figure 10:
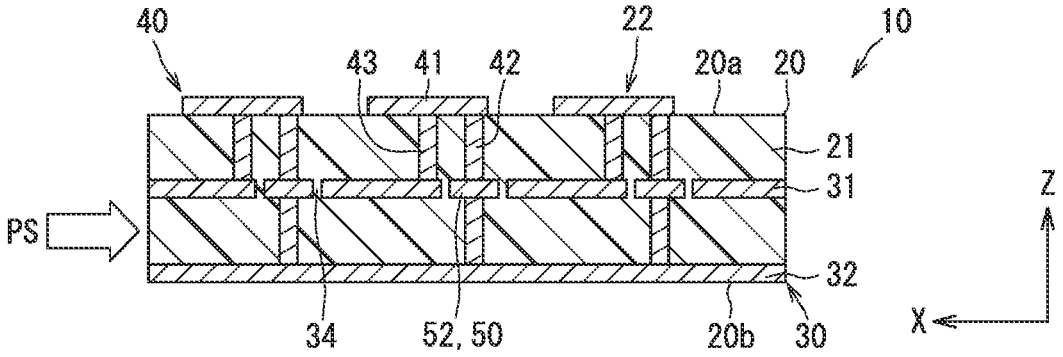
FIG. 10 is a cross-sectional view showing an antenna device according to a second embodiment.

FIG. 10 is a cross-sectional view showing the antenna device 10 according to the second embodiment. FIG. 10 corresponds to FIG. 2. As shown in FIG. 10, the matching portion 50 includes an inner layer pattern 52 arranged in the opening 34. The inner layer pattern 52 is also connected to the feeding line 42 at a position away from the patch portion 41 so as to face the lower wall portion 32. The inner layer pattern 52 is connected not at the tip of the feeding line 42 but in a middle thereof. The inner layer pattern 52 is arranged on the same surface as the upper wall portion 31 in the substrate 20. The inner layer pattern 52 corresponds to the second inner layer pattern. Other configurations are the same as those described in the prior embodiments.

Summary of Second Embodiment

As described above, the matching portion 50 of the present embodiment includes the inner layer pattern 52. By providing the inner layer pattern 52, the capacitors are connected in parallel and the inductors are connected in series with respect to the impedance of the waveguide 30. As a result, the impedance is made smaller than that of the waveguide 30 by the matching portion 50, and the impedance of the waveguide 30 and the impedance of the antenna 40 can be matched.

Further, since the inner layer pattern 52 is arranged on the same surface as the upper wall portion 31, it can be formed by the same process as the upper wall portion 31. That is, the manufacturing process can be simplified.

THIRD EMBODIMENT

The second embodiment is a modification of the preceding embodiment as a basic configuration and may incorporate description of the preceding embodiments. In the above embodiments, the matching portion is configured by the inner layer pattern located in the waveguide. Instead of this configuration, the matching portion may be configured by an inner layer pattern located outside the waveguide.

Figure 11:
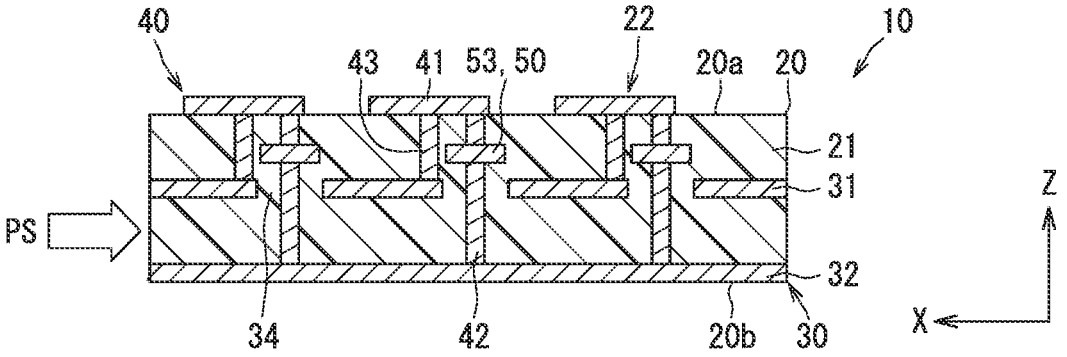
FIG. 11 is a cross-sectional view showing an antenna device according to a third embodiment.

FIG. 11 is a cross-sectional view showing the antenna device 10 according to the present embodiment. FIG. 11 corresponds to FIG. 12. As shown in FIG. 11, the matching portion 50 includes an inner layer pattern 53 arranged between the patch portion 41 and the upper wall portion 31 in the Z direction. The inner layer pattern 53 is also connected to the feeding line 42 at a position away from the patch portion 41 so as to face the lower wall portion 32. The inner layer pattern 53 is connected not at the tip of the feeding line 42 but in a middle thereof. The inner layer pattern 53 may be smaller than the opening 34 in a plan view, or may have a size consistent with the opening 34. Furthermore, it may be larger than the opening 34. The inner layer pattern 53 corresponds to the third inner layer pattern. Other configurations are the same as those described in the prior embodiments.

Summary of Third Embodiment

As described above, the matching portion 50 of the present embodiment includes the inner layer pattern 53. By providing the matching portion 50 at a position away from the lower wall portion 32, the capacitor is connected in parallel and the inductor is connected in series with respect to the impedance of the waveguide 30 as in the configuration of the second embodiment. As a result, the impedance is made smaller than that of the waveguide 30 by the matching portion 50, and the impedance of the waveguide 30 and the impedance of the antenna 40 can be matched.

Fourth Embodiment

The second embodiment is a modification of the preceding embodiment as a basic configuration and may incorporate description of the preceding embodiments. The matching portion can be combined in various ways as shown in the preceding embodiments.

Figure 12:
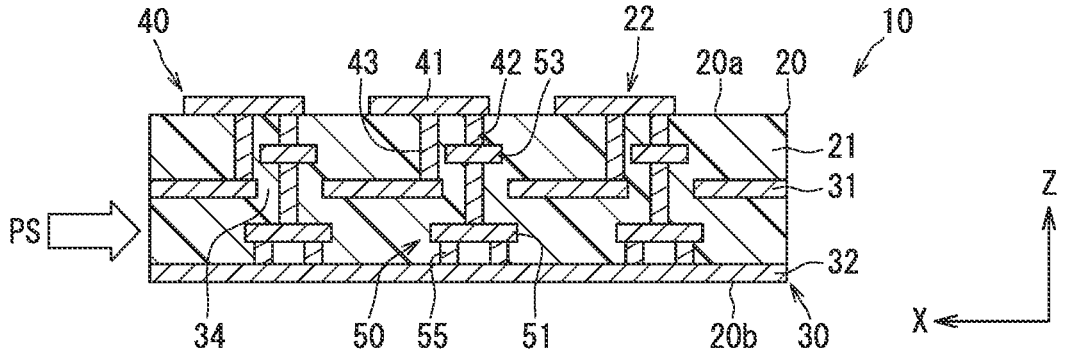
FIG. 12 is a cross-sectional view showing an antenna device according to a fourth embodiment.

FIG. 12 is a cross-sectional view showing the antenna device 10 according to the present embodiment. FIG. 12 corresponds to FIG. 2. As shown in FIG. 12, the matching portion 50 is a combination of the configuration shown in FIG. 4 and the configuration shown in FIG. 11. That is, the matching portion 50 includes the inner layer pattern 51 and the via conductor 55 arranged inside the waveguide 30, and the inner layer pattern 53 arranged outside the waveguide 30. Other configurations are the same as those described in the prior embodiments.

Summary of Fourth Embodiment

According to the configuration shown in FIG. 12, the opening area of the waveguide 30 is reduced by the inner layer pattern 51 and the via conductor 55 in the matching portion 50. Further, the capacitor and the inductor are connected to the impedance of the waveguide 30 by the inner layer pattern 53 of the matching portion 50. With the above two configurations, the impedance is made smaller than that of the waveguide 30 by the matching portion 50, and the impedance of the waveguide 30 and the impedance of the antenna 40 can be matched.

In addition to the example shown in FIG. 12, the matching portion 50 can be combined in various ways. For example, as the matching portion 50, a combination of the configuration shown in FIG. 4 and the configuration shown in FIG. 10 may be adopted. Needless to say, in combination of the configurations shown in FIGS. 10 and 11, the configuration shown in FIG. 9 may be adopted instead of the configuration shown in FIG. 4.

FIFTH EMBODIMENT

The second embodiment is a modification of the preceding embodiment as a basic configuration and may incorporate description of the preceding embodiments. In the prior embodiments, the patch portions were arranged in a row. Instead of this arrangement, the patch portions may be arranged in a plurality of rows.

Figure 13:
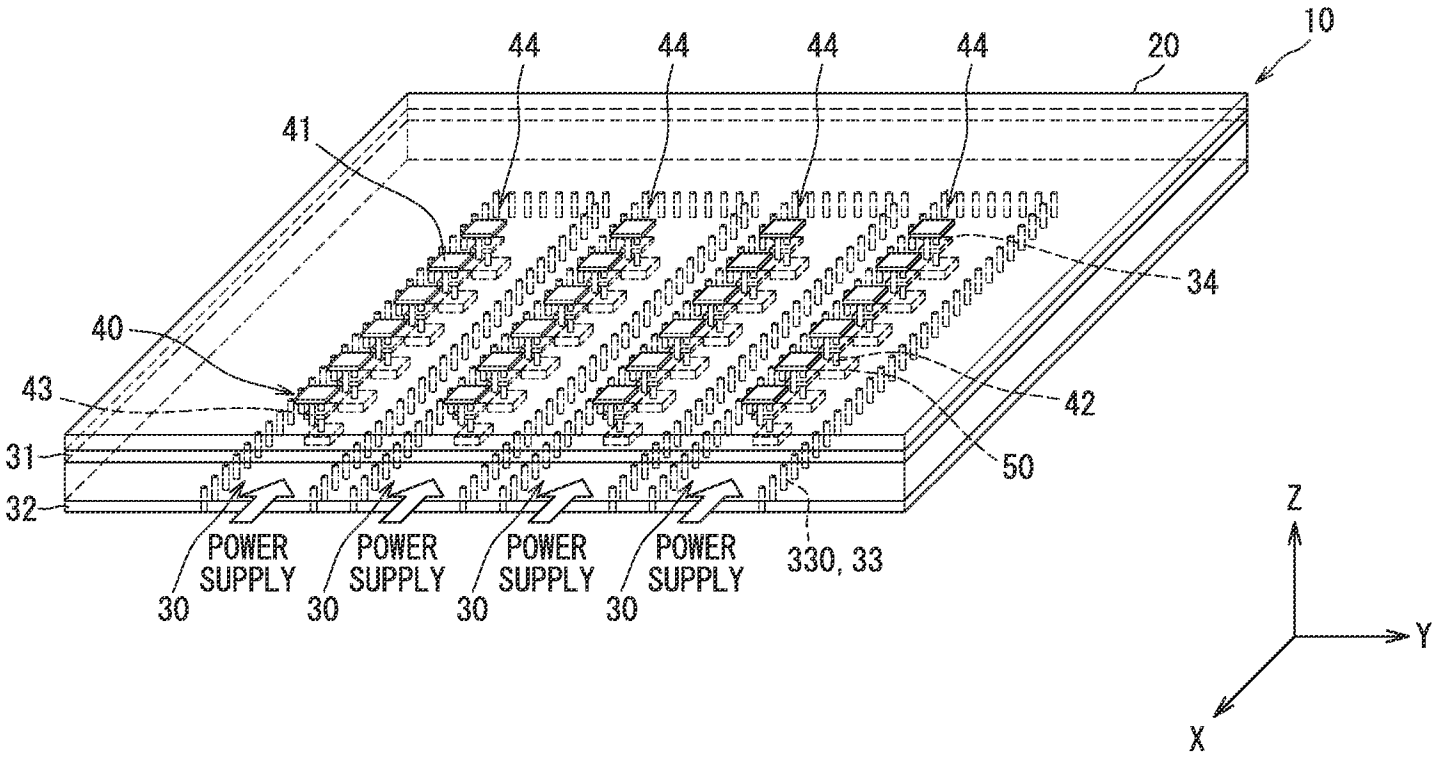
FIG. 13 is a perspective view showing an antenna device according to a fifth embodiment.

FIG. 13 is a perspective view showing the antenna device 10 according to the present embodiment. FIG. 13 corresponds to FIG. 5. As shown in FIG. 13, the antenna 40 includes a plurality of element rows 44 in which a plurality of elements are arranged in a line. The element row is sometimes referred to as an array row. Specifically, it includes four element rows 44. Each of the element rows 44 has six patch portions 41. The six patch portions 41 constituting one element row 44 are arranged side by side in the X direction with the above-mentioned predetermined intervals. The intervals adjacent to each other in the X direction are equal to each other in each element row 44. The four element rows 44 are arranged side by side in the Y direction. The plurality of patch portions 41 are arranged in a grid pattern.

A plurality of waveguides 30 are provided in the substrate 20 corresponding to the element rows 44. Specifically, four waveguides 30 are partitioned by the via conductors 330 that constitute the side wall portions 33. Each of the waveguides 30 extends in the X direction. The four waveguides 30 are arranged side by side in the Y direction. The element rows 44 are arranged directly above the four waveguides 30. Other configurations are the same as those described in the prior embodiments.

Summary of Fifth Embodiment

Figure 14:
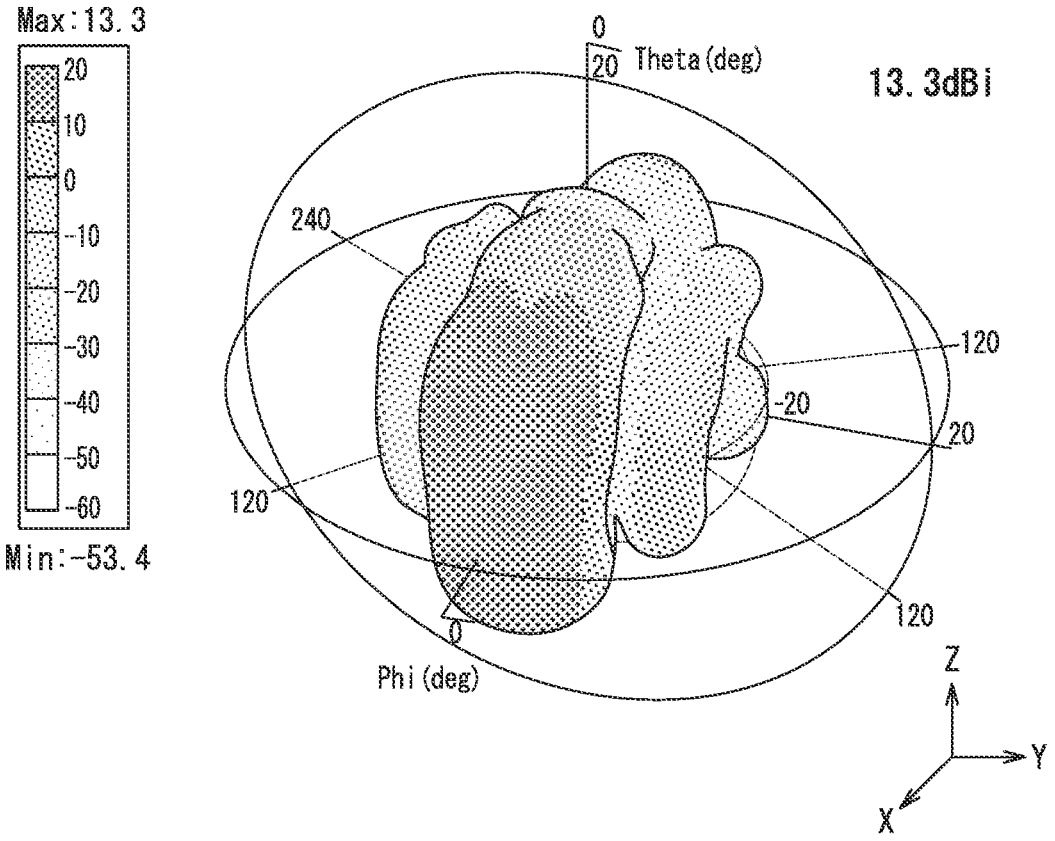
FIG. 14 is a diagram showing radiation characteristics.

FIG. 14 shows the result of performing an electromagnetic field simulation on the antenna device 10 shown in FIG. 13. The simulation conditions are the same as those in FIGS. 7 and 8 except that the number of elements was different. In this simulation, the operating frequency is 82.3 GHz and the dielectric constant is 3.6.

As shown in FIG. 14, the maximum gain was 13.3 dBi. As described above, by increasing the number of elements not only in the X direction but also in the Y direction, the maximum gain of the antenna 40 is further improved. Further, the antenna 40 shows directivity in the X direction.

The number of patch portions 41 constituting one element row 44 is not limited to six. Further, the number of element rows 44 is not limited to four.

SIXTH EMBODIMENT

The second embodiment is a modification of the preceding embodiment as a basic configuration and may incorporate description of the preceding embodiments.

Figure 15:
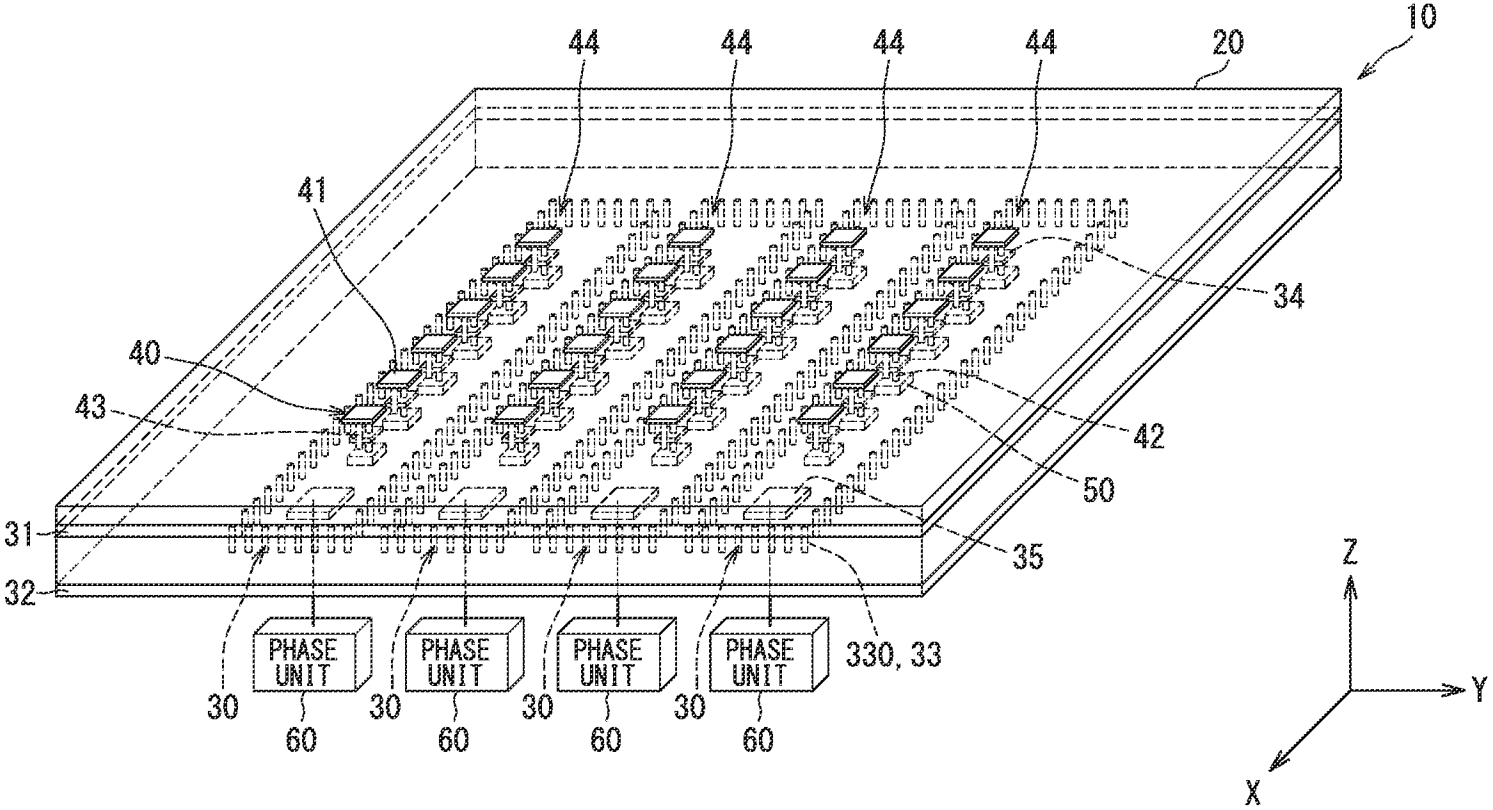
FIG. 15 is a perspective view showing an antenna device according to a sixth embodiment.

FIG. 15 is a perspective view showing the antenna device 10 according to the present embodiment. FIG. 15 corresponds to FIG. 13. As shown in FIG. 15, the antenna device 10 includes a phase unit 60. The phase unit 60 is individually provided with respect to the waveguide 30. The phase unit 60 adjusts the phase of the current flowing through the element row 44 of the antenna 40. The antenna 40 provided with the phase unit 60 is sometimes referred to as a phased array antenna.

The waveguide 30 has a configuration in which both ends in the X direction are closed by the via conductors 330. In each waveguide 30, the opening 35 is formed in the lower wall portion 32. The opening 35 is formed on one end side of the waveguide 30 in the X direction. The opening 35 penetrates the lower wall portion 32 in the Z direction. The phase unit 60 is connected to the waveguide 30 through the opening 35. Other configurations are the same as those described in the prior embodiments.

Summary of Sixth Embodiment

Figure 16:
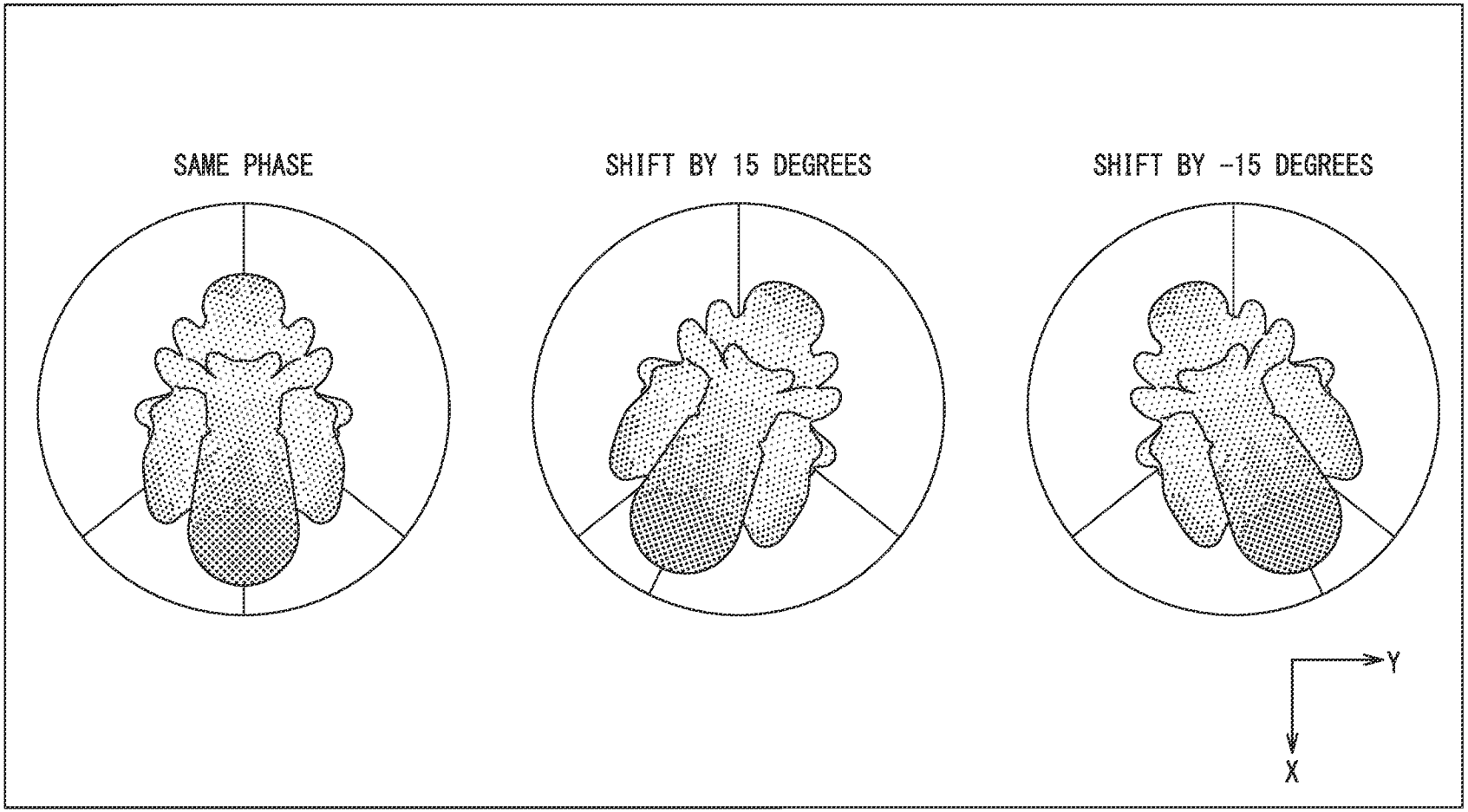
FIG. 16 is a diagram showing radiation characteristics.

FIG. 16 shows the result of performing an electromagnetic field simulation on the antenna device 10 shown in FIG. 15. FIG. 16 shows the radiation directivity along the XY plane. The simulation conditions are the same as in FIG. 13. FIG. 16 shows the results when the phases of the four element rows 44 are the same, when the phases are shifted by 15 degrees, and when the phases are shifted by −15 degrees.

As shown in FIG. 16, in the case of the same phase, the radiation direction of the main beam is the X direction. By shifting the phase, the radiation direction of the main beam can be shifted to the left or right with reference to the radiation direction of the same phase. In this way, the beam can be directed in an arbitrary direction by adjusting the phase of the current flowing through each element row 44 of the antenna 40.

OTHER EMBODIMENTS

The disclosure in this specification and drawings is not limited to the exemplified embodiments. The disclosure encompasses the illustrated embodiments and modifications by those skilled in the art based thereon. For example, the disclosure is not limited to the combinations of components and/or elements shown in the embodiments. The disclosure may be implemented in various combinations. The disclosure may have additional portions that may be added to the embodiments. The disclosure encompasses omission of components and/or elements of the embodiments. The disclosure encompasses the replacement or combination of components and/or elements between one embodiment and another. The disclosed technical scope is not limited to the description of the embodiments. It should be understood that some disclosed technical ranges are indicated by description of claims, and includes every modification within the equivalent meaning and the scope of description of claims.

The disclosure in the specification, drawings and the like is not limited by the description of the claims. The disclosures in the specification, the drawings, and the like encompass the technical ideas described in the claims, and further extend to a wider variety of technical ideas than those in the claims. Therefore, various technical ideas can be extracted from the disclosure of the specification, the drawings and the like without being limited to the description of the claims.

When an element or a layer is described as "disposed above" or "connected", the element or the layer may be directly disposed above or connected to another element or another layer, or an intervening element or an intervening layer may be present therebetween. In contrast, when an element or a layer is described as "disposed directly above" or "directly connected", an intervening element or an intervening layer is not present. Other terms used to describe the relationships between elements (for example, "between" vs. "directly between", and "adjacent" vs. "directly adjacent") should be interpreted similarly. As used herein, the term "and/or" includes any combination and all combinations relating to one or more of the related listed items. For example, the term A and/or B includes only A, only B, or both A and B.

Spatial relative terms "inside", "outside", "back", "bottom", "low", "top", "high", etc. are used herein to facilitate the description that describes relationships between one element or feature and another element or feature. Spatial relative terms can be intended to include different orientations of a device in use or operation, in addition to the orientations depicted in the drawings. For example, when the device in the figure is flipped over, an element described as "below" or "directly below" another element or feature is directed "above" the other element or feature. Therefore, the term "below" can include both above and below. The device may be oriented in the other direction (rotated 90 degrees or in any other direction) and the spatially relative terms used herein are interpreted accordingly.

An example including the inner layer pattern 51 and the via conductor 55 as the matching portion 50 arranged between the upper wall portion 31 and the lower wall portion 32 has been shown, but the present disclosure is not limited thereto. The configuration may include only the inner layer pattern 51. That is, the matching portion 50 may be arranged between the upper wall portion 31 and the lower wall portion 32 and may not be connected to the lower wall portion 32.

An example is shown in which the feeding line 42 including the matching portion 50 is connected to the lower wall portion 32, but the present disclosure is not limited to this configuration. As described above, the feeding line 42 and/or the feeding line 42 including the matching portion 50 is extended below the center of the height of the waveguide 30 for feeding from the waveguide 30. For example, in the configuration shown in FIG. 10, the feeding line 42 may not be connected to the lower wall portion 32.

What is claimed is:

1. An antenna device, comprising: a substrate having a base material containing a dielectric and a conductor arranged in the base material; a waveguide that is arranged in the base material as a part of the conductor, and has an upper wall portion, a lower wall portion facing the upper wall portion in a plate thickness of the base material, and a side wall portion connected to the upper wall portion and the lower wall portion; an antenna that is arranged in the base material as a part of the conductor, and has a plurality of patch portions arranged in an array so as to face the upper wall portion in the plate thickness direction, a plurality of feeding lines extending in the plate thickness direction from the patch portions and individually provided for the patch portions, and a plurality of short-circuit portions individually provided for the patch portions and electrically connecting the patch portions and the upper wall portion; and a matching portion that is arranged in the base material as a part of the conductor and is individually provided with respect to the patch portions in order to match an impedance of the waveguide and an impedance of the antenna; wherein the upper wall portion has a plurality of openings individually formed with respect to the feeding lines, and each of the feeding lines extends to an inside of the waveguide through a corresponding opening.

2. The antenna device according to claim 1, wherein each of the feeding lines includes a first via conductor.

3. The antenna device according to claim 1, wherein the matching portion includes an inner layer pattern connected to the feeding line at a position away from the patch portions so as to face the lower wall portion.

4. The antenna device according to claim 3, wherein the inner layer pattern includes a first inner layer pattern arranged between the upper wall portion and the lower wall portion in the plate thickness direction.

5. The antenna device according to claim 4, wherein the matching portion includes the first inner layer pattern and a second via conductor arranged in the waveguide and connected to the inner layer pattern, is connected to an inner surface of the lower wall portion, and has a predetermined height from the inner surface.

6. The antenna device according to claim 3, wherein the inner layer pattern includes a second inner layer pattern arranged in the opening.

7. The antenna device according to claim 3, wherein the inner layer pattern includes a third inner layer pattern arranged between the patch portions and the upper wall portion in the plate thickness direction.

* * * * *